US005420668A

United States Patent [19]

Okano

[11] Patent Number: 5,420,668

[45] Date of Patent: May 30, 1995

[54] IMAGE FORMING APPARATUS

[75] Inventor: Yoshiaki Okano, Tokyo, Japan

[73] Assignee: Kabushiki Kaisha Toshiba, Kanagawa, Japan

[21] Appl. No.: 208,149

[22] Filed: Mar. 10, 1994

[30] Foreign Application Priority Data

Mar. 11, 1993 [JP] Japan ..... 5-050699

[51] Int. Cl.[6] ..... G03G 15/14

[52] U.S. Cl. ..... 355/206; 355/271

[58] Field of Search ..... 355/206, 205, 209, 271, 355/274

[56] References Cited

U.S. PATENT DOCUMENTS

| | | | |
|---|---|---|---|
| 5,150,165 | 9/1992 | Asai | 355/274 |
| 5,253,022 | 10/1993 | Takeuchi et al. | 355/274 |
| 5,287,149 | 2/1994 | Hoshika | 355/271 X |
| 5,337,127 | 8/1994 | Imaue | 355/271 |

FOREIGN PATENT DOCUMENTS 3-69978 3/1991 Japan .

*Primary Examiner*—R. L. Moses

*Attorney, Agent, or Firm*—Finnegan, Henderson, Farabow, Garrett & Dunner

[57] ABSTRACT

An image forming apparatus including a rotatable photosensitive member, charging means for charging the photosensitive member at a predetermined potential, developing means for supplying toner to the photosensitive member to provide a developed image, transfer means including a transfer roller for transferring the developed image to a paper sheet, paper removal detecting means for detecting that a jammed paper is removed from the image forming apparatus, stopping means responsive to the jammed paper removal detecting means for stopping supply of the toner to the photosensitive member, rotating means responsive to the paper removal detecting means for rotating the photosensitive member and the transfer roller, and setting means responsive to the paper removal detecting means for setting the circumference of the transfer roller alternately in a first state, in which the circumference of the transfer roller is supplied with a first voltage more negative than the predetermined potential of the photosensitive member, and in a second state in which the circumference of the transfer roller is supplied with a second voltage more positive than the predetermined potential of the photosensitive member.

11 Claims, 8 Drawing Sheets

WHEN JAMMED PAPER IS REMOVED

IMAGE FORMING APPARATUS

BACKGROUND OF THE INVENTION

1. Field of the Invention

The present invention relates to image forming apparatus such as facsimile and copying machines, and, more particularly, to an image forming electrophotographic apparatus and process.

2. Description of the Related Art

The conventional image forming apparatus is shown in FIG. 10 of the accompanying drawings to include a photosensitive drum 1. A charging device 2, an exposure device 3, a developing device 4, a transfer device 6, and a cleaning device 8 are arranged around the outer circumferential surface of the photosensitive drum 1. Of these components, the photosensitive drum 1, the charging device 2, the developing device 4, and the cleaning device 8 are integrally supported by side frames (not shown) to provide the assembled process unit 100.

In operation, the photosensitive drum 1 is rotated in the clockwise direction, the charging device 2 charges the surface of the photosensitive drum 1 to a predetermined potential (e.g., −600 V) and the exposure device 3 is controlled in response to an image data of an image to be recorded.

The developing device 4 comprises a toner hopper 41, a toner pack 42, a feed roller 43, a developing roller 44, a developing blade 45, a support rod 46, a leaf spring 47, a support 48, and a reinforcing plate 49.

The toner hopper 41 is a hollow container, having partially open upper surfaces, for storing toner (not shown) therein. The toner pack 42 is mounted on the upper open portion of the toner hopper 41. The toner pack 42 is filled with the toner and is provided with an opening initially sealed with a removable seal sheet (not shown). When the seal sheet is removed and the toner pack 42 is mounted on the toner hopper 41, the toner empties into the toner hopper 41.

The feed roller 43 is arranged at an opening on the side surface of the toner hopper 41 such that it is partly located in the toner hopper 41. The developing roller 44 lightly contacts both the photosensitive drum 1 and the feed roller 43. The feed roller 43 is rotated in the counterclockwise direction by a rotary drive mechanism (not shown). The developing roller 44 is also rotated in the counterclockwise direction. The feed roller 43 carries the toner stored in the toner hopper 41 and supplies it to the developing roller 44. The developing roller 44 carries the toner given by the feed roller 43 and causes it to contact the surface of the photosensitive drum 1.

The cylindrical support rod 46 is arranged parallel to and above the developing roller 44 to support the developing blade 45 in contact with the developing roller 44. The leaf spring 47, which is fixed to the support 48, urges the support rod 46 toward the developing roller 44 with a predetermined force F. Thus, the developing blade 45 is urged against the developing roller 44. The support 48 is fixed to a side wall of the toner hopper 41.

The transfer device 6 includes a transfer roller 61 rotating in a counterclockwise direction in contact with the photosensitive drum 1. The transfer device 6 further includes a positive direct-current power source 64 and a negative direct-current power source 65. The transfer roller 61 is alternatively coupled to one of the positive direct-current power source 64 and the negative direct-current power source 65.

The cleaning device 8 includes a cleaning blade 82 contacting the photosensitive drum 1 for cleaning toner remaining on the photosensitive drum 1 after the transferring operation.

In the facsimile apparatus having the structure as described above, an image is printed in the following manner.

First, the charging device 2 charges the photosensitive surface of the photosensitive drum 1 to a predetermined potential (e.g., −600 V). Subsequently, the exposure device 3 exposes the charged photosensitive surface of the drum 1 in accordance with an image to be printed, thereby forming an electrostatic latent image. Then, the developing device 4 develops the electrostatic latent image formed on the photosensitive surface of the drum 1.

In the developing device 4, the feed roller 43 carries the toner to the developing roller 44. The developing roller 44 carries and conveys the toner. When the developing roller 34 rotates, toner carried on the developing roller 34 receives friction between the developing roller 44 and developing blade 45. As a result, the toner is charged by friction. An acrylic resin layer, which tends to be charged in positive polarity, is provided at the surface of the developing roller 44. The resin layer is charged with positive polarity by friction with the toner. Accordingly, the toner is charged with negative polarity due to the polarization effect caused by the resin layer.

A developing bias, for example −200 V, having the same polarity as that of the potential charged on the photosensitive drum 1, is applied to the developing roller 44. The toner selectively attaches to the photosensitive drum 1 due to the presence of the electric field among the electrostatic latent image, the developing bias, and the charge of toner. More particularly, the toner does not attach to the non-exposed portion of the photosensitive drum 1 since the potential at this portion of the photosensitive drum 1 is more negative than that of the developing roller 44 transporting the toner. The toner attaches to the exposed portion of the photosensitive drum 1 since the potential at this portion of the photosensitive drum 1 is less negative than that of the developing roller 44 transporting the toner. In this manner, a toner image corresponding to the electrostatic latent image is formed on the surface of the photosensitive drum 1. This toner image is transferred to the paper P by a positive voltage of the transfer roller 61, which is supplied by the positive direct-current power source 64.

After the printed sheet P is separated from the photosensitive surface of the photosensitive drum 1, the toner which is not transferred, and remains on the surface of the photosensitive drum 1, is removed by the cleaning device 8.

While the paper P is conveyed, a paper jam sometimes occurs. When the paper jam occurs, the photosensitive drum 1, the feed roller 43, the developing roller 44, and the transfer roller 61 continue to be rotated until the user removes the jammed paper from the apparatus. During this period, the transfer roller 61 remains supplied with the positive voltage from the positive direct-current power source 64. Therefore, the toner adhering on the photosensitive drum 1 having negative charge is transferred to the transfer roller 61 supplied with the positive voltage.

In this state, if the user removes the jammed paper from the apparatus and the apparatus performs a next recording operation, the toner transferred to and adhering to the transfer roller 61, transfers and adheres to the surface of the paper opposite to a recorded surface since the transfer roller 61 urges the paper toward the photosensitive drum 1, and therefore contacts the paper. As a result, the surface of the paper becomes dirty due to the toner from the transfer roller 61.

FIG. 11 shows a conventional sequence for solving the above deficiency. T1 is an instant of time following a predetermined period of time after the jammed paper is removed from the apparatus and a cover of the apparatus (not shown) is closed. T2 is an instant of time when a next recording operation starts. A period from the time T1 to the time T2 is referred to as a period TJ.

During the period TJ, the photosensitive drum 1 and the transfer roller 61 rotates. The charging device 2 charges the photosensitive drum 1 during the period TJ at −600 V. Furthermore, the developing roller 44 is supplied with the predetermined voltage, e.g., −200 V.

Furthermore, the negative voltage (e.g., −1350 V) from the negative direct-current power source 65 has been supplied to the transfer roller 61 during the period TJ. Thus, the toner including negative charge adhering to the transfer roller 61 during the paper jam, is repelled to the photosensitive drum 1 rotating in contact with the transfer roller 61 during the period TJ since the potential of the transfer roller 61 (−1350 V) is more negative than that of the photosensitive drum 1 (−600 V). During the period TJ, rotation of the developing roller 44 is stopped so that the developing roller 44 does not supply toner from the developing device 4 to the photosensitive drum 1.

Most of the toner on the drum 1 at this time is negatively charged. However, there is some toner with a positive charge more than negative charge adhering on the photosensitive drum 1 while the paper jam occurs. The ratio of the toner with a positive charge more than negative charge is several percent. This results from the toner receiving insufficient friction between the developing roller 44 and the developing blade 45. For this reason, toner having a positive charge on the photosensitive drum 1 is not repelled against the transfer roller 61 supplied with negative voltage. As a result, the toner having positive charge is attracted to the transfer roller 61 during the period TJ and causes the surface of the paper opposite to the recorded surface to be dirty during the next recording operation.

SUMMARY OF THE INVENTION

Accordingly, the present invention has been made in view of the above circumstances and has an object to provide a image forming apparatus which prevents the surface of paper opposite to a recorded surface from becoming dirty due to toner adhering to the transfer roller after a paper jam occurs.

Additional objects and advantages of the invention will be set forth in part in the description which follows and in part will be apparent from the description, or may be learned by practice of the invention. The objects and advantages of the invention may be realized and attained by means of the instrumentalities and combinations particularly pointed out in the written description and claims hereof as well as appended drawings.

To achieve these and other objects and advantages and in accordance with the purposes of the invention, there is provided an image forming apparatus including a rotatable photosensitive member, charging means for charging the photosensitive member at a predetermined potential, developing means for supplying toner to the photosensitive member to provide a developed image, transfer means including a transfer roller for transferring the developed image to a paper sheet, paper removal detecting means for detecting that a jammed paper is removed from the image forming apparatus, stopping means responsive to the jammed paper removal detecting means for stopping supply of the toner to the photosensitive member, rotating means responsive to the paper removal detecting means for rotating the photosensitive member and the transfer roller, and setting means responsive to the paper removal detecting means for setting the circumference of the transfer roller alternately in a first state, in which the circumference of the transfer roller is supplied with a first voltage more negative than the predetermined potential of the photosensitive member, and in a second state in which the circumference of the transfer roller is supplied with a second voltage more positive than the predetermined potential of the photosensitive member.

It is to be understood that both the foregoing general description and the following detailed description are exemplary and explanatory and are intended to provide further explanation of the invention as claimed.

DESCRIPTION OF THE PREFERRED EMBODIMENTS

Figure 10:
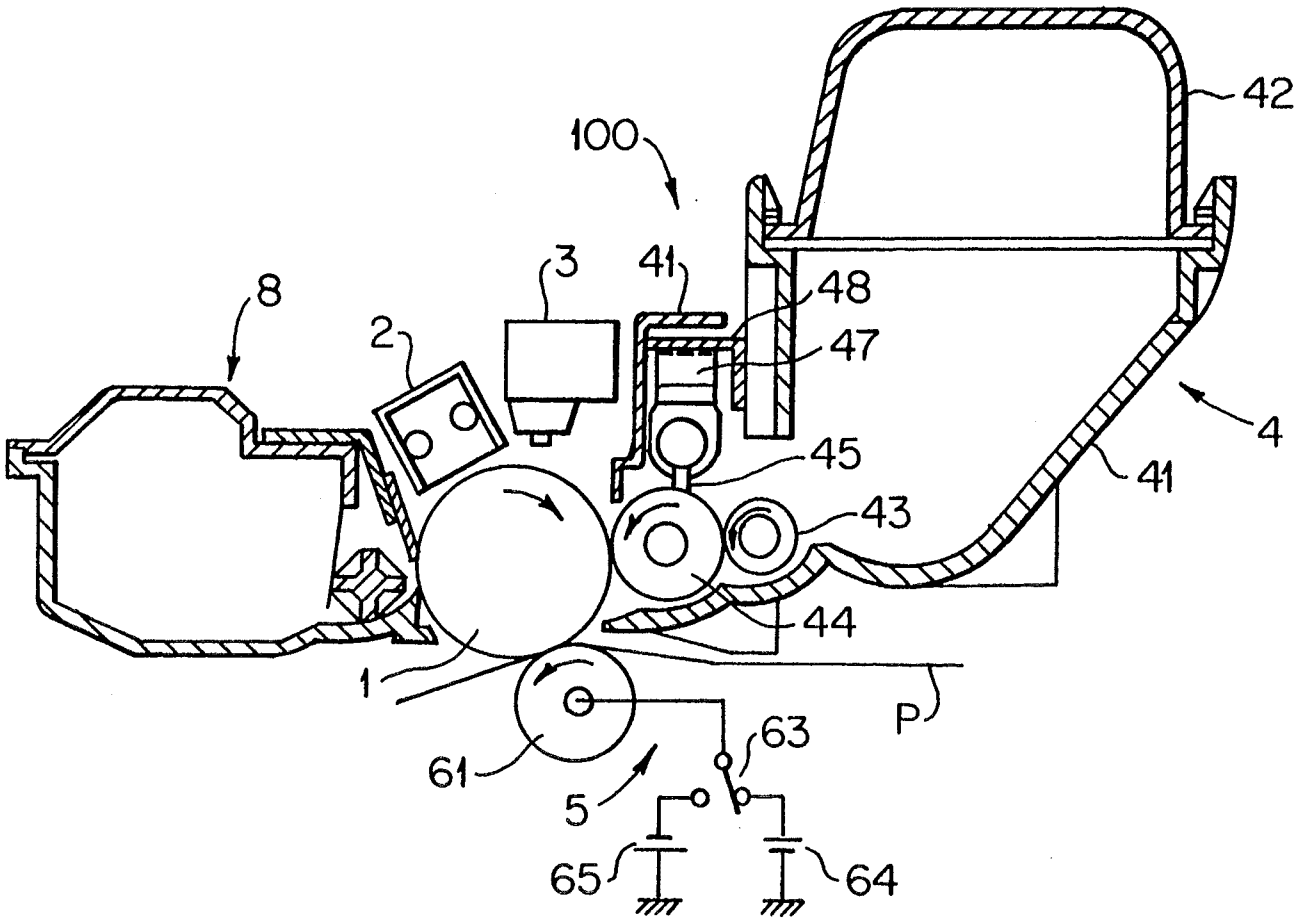

Reference will now be made in detail to the present preferred embodiments of the invention, examples of which are illustrated in the accompanying drawings. Common elements of the embodiments and the conventional apparatus as shown in FIG. 10, have the same reference numerals, and their explanations are omitted.

A control circuit 71 is output coupled to a charging power source switch 22. The switch 22 connects a charger 21 to a charging power source 23 in response to a signal from the control circuit 71. The control circuit 71 is also coupled for output to a motor 62 for driving the photosensitive drum 1 and the transfer roller 61, and to a transfer power source switch 63 for alternatively connecting the transfer roller 61 to the positive and negative power sources 64, 65. The control circuit 71 is additionally output coupled to a motor 51 for driving the developing roller 44, and a developing roller power source switch 53 for connecting the developing roller 44 to a negative power source 55 in response to a signal from the control circuit 71.

The control circuit 71 is further coupled for input from an image forming apparatus cover open/close sensor 57 for checking whether the cover of the image forming apparatus, including the process unit 100, is closed or opened. The control circuit 71 is coupled for output to and input from a timer 72, and for output to an LCD driver 73 for driving an LCD 74. The control circuit 71 further coupled for output to and input from a paper passing sensor 75 including a radiator **75*a* and a receiver 75*b*. If the receiver 75*b* receives the light from the radiator 75*a*, the receiver 75*b* outputs a signal indicating that there is not a sheet of paper between the radiator 75*a* and the receiver 75*b*. The sensor 75 is provided between a pair of first paper feed rollers 76 and a pair of second paper feed rollers 77. The second paper feed rollers 77 are rotated by the driving motor 51 in response to a control signal from the control circuit 71**.

Figure 1:
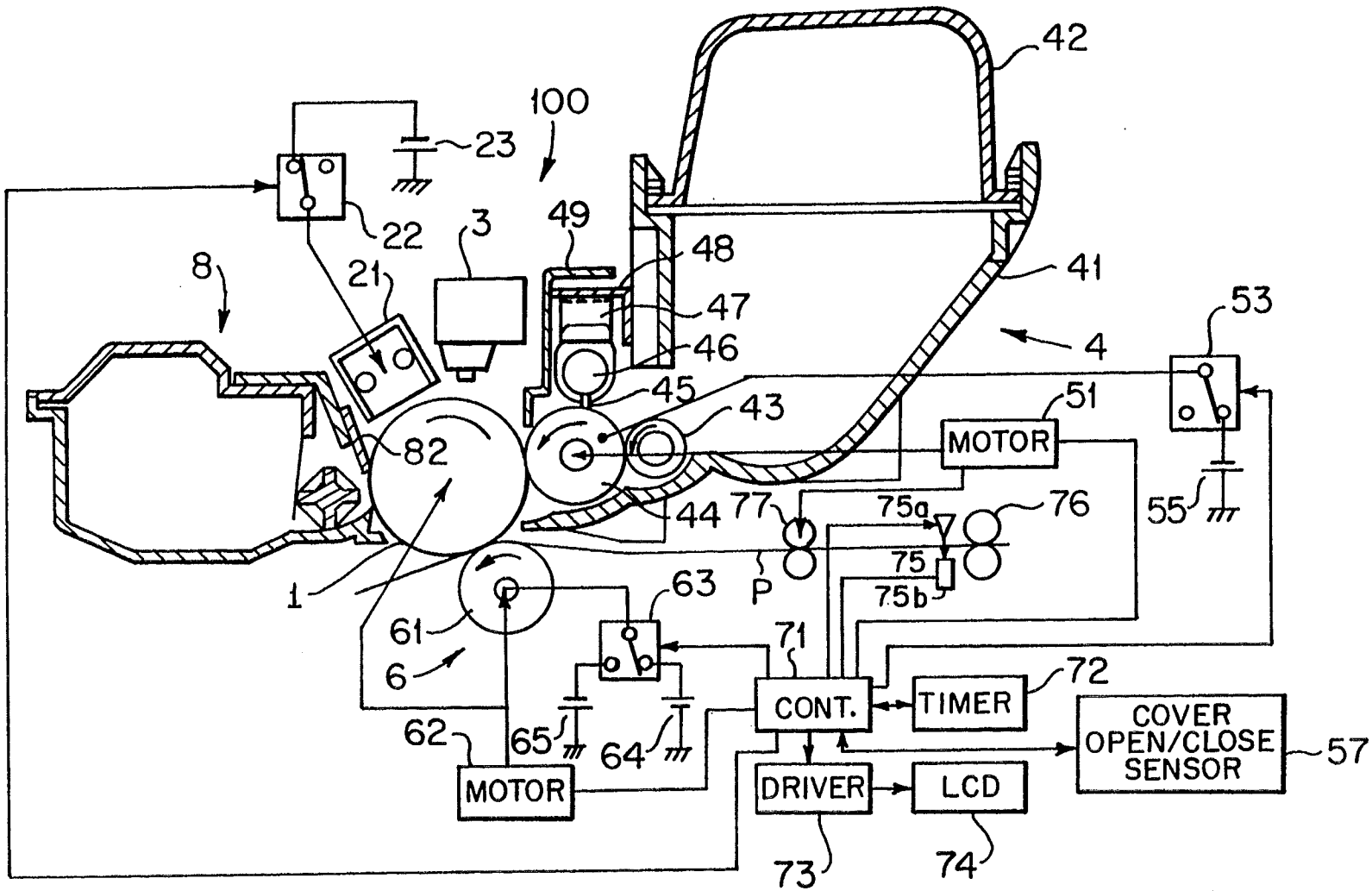
FIG. 1 is a schematic view illustrating an image forming apparatus used in a conventional apparatus and a first and second embodiments of a present invention.
Figure 2:
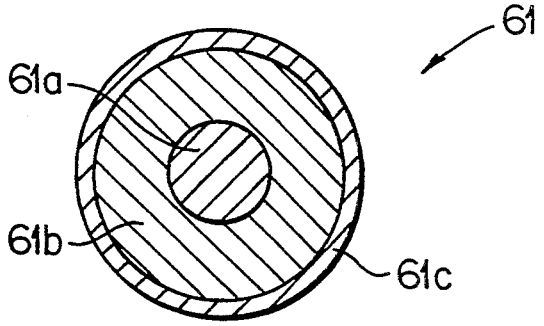
FIG. 2 is a timing chart illustrating a sequence of the conventional apparatus.

FIG. 2 shows a structure of the transfer roller 61 such as that shown in FIG. 1. The transfer roller 61 includes a metal shaft **61*a*, a conductive sponge layer 61*b* including carbon. The conductive sponge layer 61*b* is preferably less than $10^5\ \Omega$. The transfer roller 61 further includes a resistance layer 61*c***.

Figure 3:
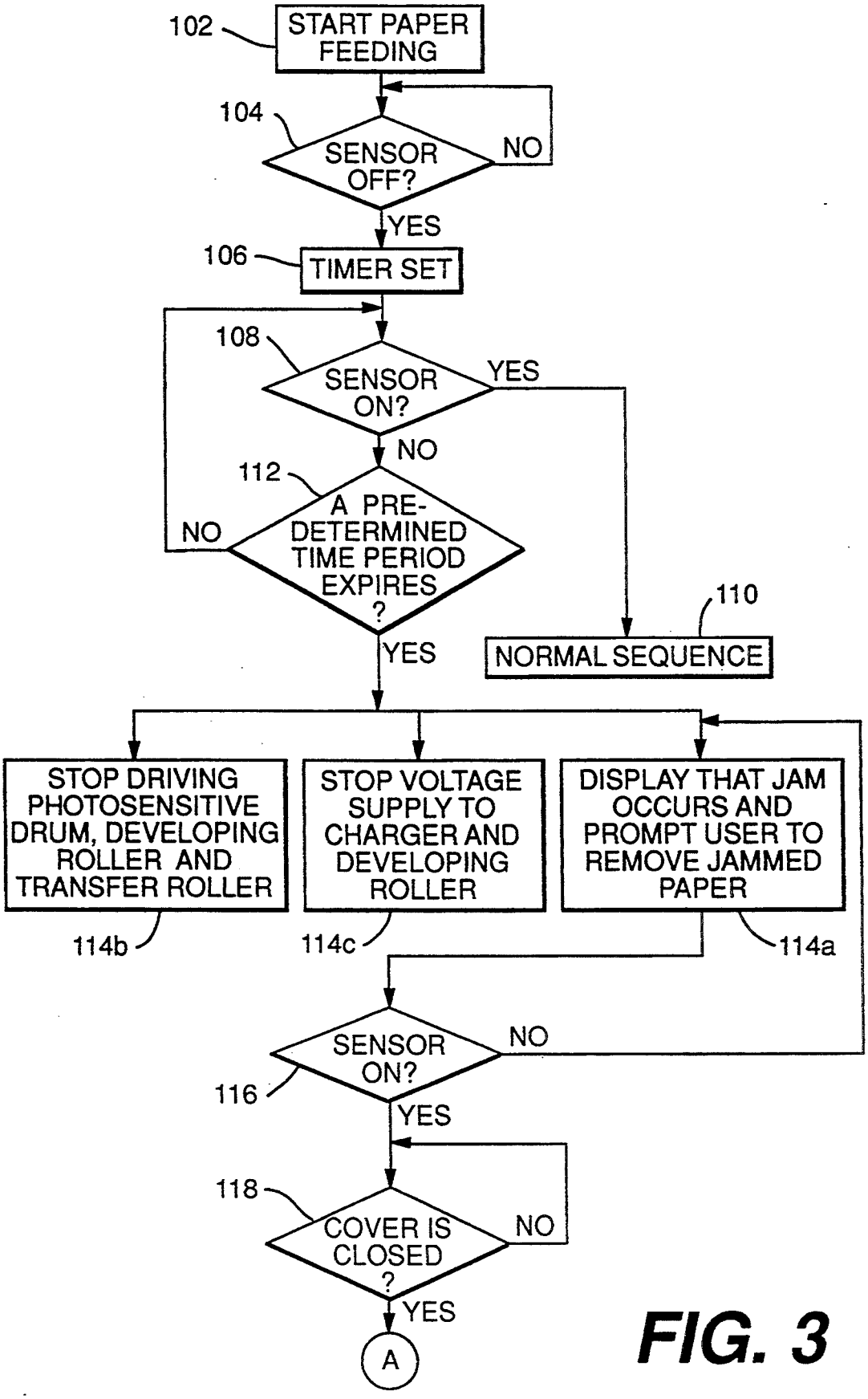
FIG. 3 is a cross-sectional side view illustrating a transfer roller used in the first and second embodiments.
Figure 4:
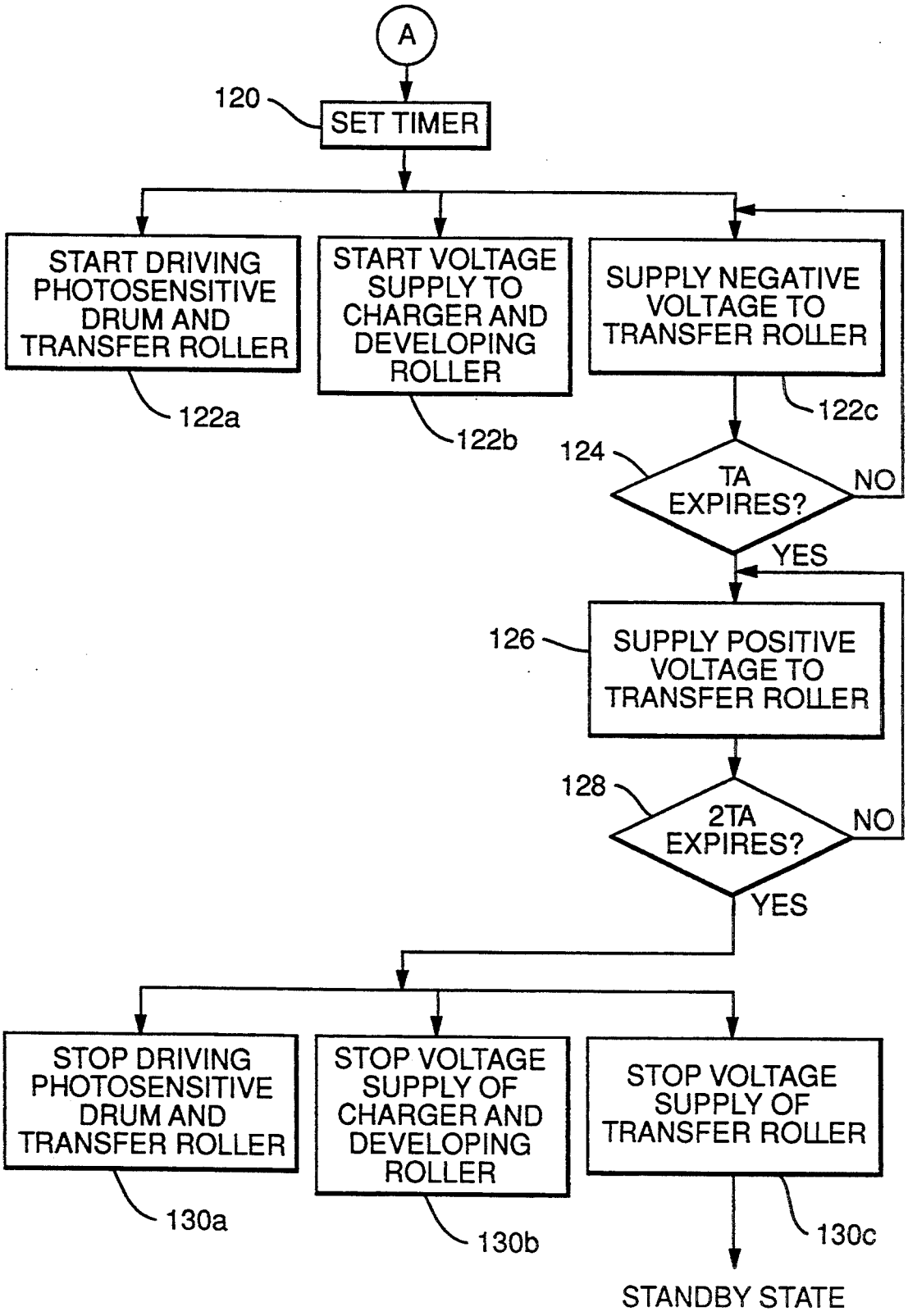
FIG. 4 is a flow chart illustrating a sequence for detecting whether paper is jammed and whether the jammed paper is removed.

FIG. 3 and 4 show a control sequence for a first embodiment of the invention, including steps for detecting a paper jam occurring between the first and second feed rollers 76, 77 of FIG. 1 and for informing the user that the paper jam has occurred.

After the first paper feed roller 76 starts feeding a sheet of paper (step 102), the sensor 75 detects whether the tip of the paper passes between the radiator **75*a* and the receiver 75*b* (step 104). If the tip of the paper interrupts the light from the radiator 75*a*, the sensor 75 is set to be off. If the sensor 75 is set to be off, the timer 72 is set (step 106). Otherwise, this check is repeated. After that, the sensor 75 indicates whether the end of the paper passes through the sensor 75 (step 108). If the receiver 75*b* receives the light from the radiator 75*a*, the sensor 75 is set to be on. If the sensor 75 is set to be on, the control circuit 71 performs a normal sequence (step 110). If the sensor 75 remains off at the expiration of a predetermined time period counted by the timer 72 and detected by the control circuit 71 (step 112), the control circuit 71 recognizes that a paper jam has occurred in the region of the sensor 75. The control circuit 71 then drives the LCD driver 73 for displaying information on the LCD 74, indicating the occurrence of the paper jam, and prompting the user to remove the jammed paper (step 114*a*). Simultaneously, the control circuit 71 stops driving the photosensitive drum 1, the developing roller 44, and the transfer roller 61, and stops the voltage supply to the charger 21 and the developing roller 44 (step 114*b*, 114*c*). Prior to the expiration of the predetermined time period initiated at step 106, steps 108 and 112 are repeated. After that time period has expired, the control circuit 71 checks whether the jammed paper is removed by again determining whether the sensor 75 is set to be on (step 116). If the sensor 75 is not set to be on, the control circuit 71 maintains the display prompt and repeats step 116. After the sensor 75 is set to be on in step 116, the control circuit 71 determines whether the cover of the apparatus is closed by input from the sensor 57 (step 118). If the cover is closed, the control circuit 71** initiates a transfer roller cleaning sequence explained hereinafter.

Figure 6:
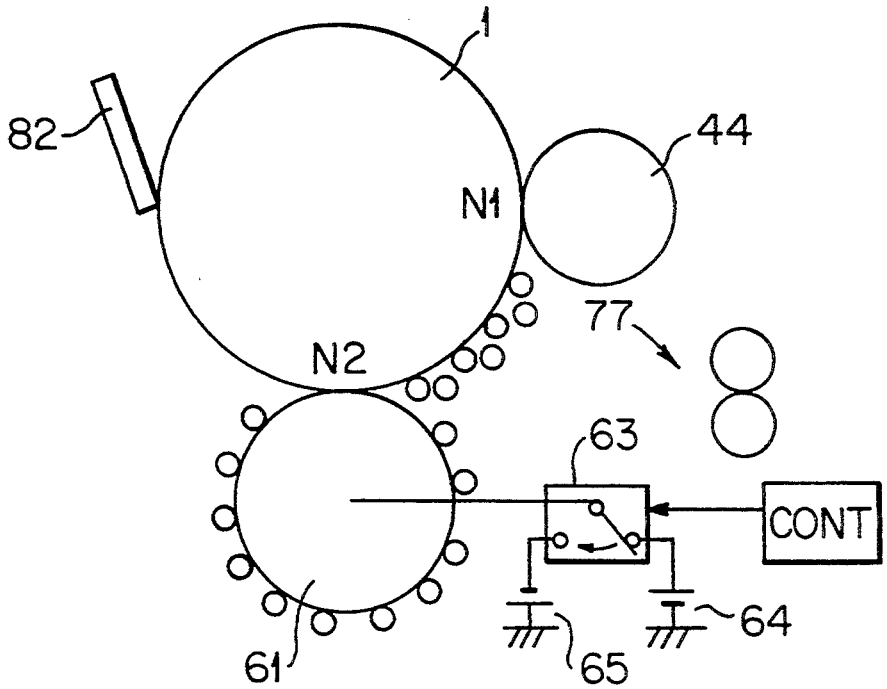
FIG. 6 is a schematic view illustrating a resulting state when the jammed paper is removed in the first and second embodiments.

In connection with the cleaning sequence to be described, it is to be noted that when the jammed paper is removed, and as shown in FIG. 6, the photosensitive drum 1 contacts the developing roller 44 at a first contact portion N1 and contacts the transfer roller 61 at a second contact portion N2. The surface from the portions N1 to N2 is referred to as an arc N1, N2 hereinafter.

In this state, toner having negative charge and toner having positive charge, remain on the arc N1, N2. Further, toner having negative charge adheres onto the surface of the transfer roller 61 because the transfer roller 61 is supplied with the positive voltage during a printing operation and therefore attracts the toner, having the negative charge, from the drum 1 during the occurrence of the paper jam. Also, the top surface portion of the drum 1 between the cleaner 8 and the contact portion N1, approximately 180° or one half of the drum circumference, is cleansed of toner, regardless of polarity, due to travel of that top surface portion past and in contact with the cleaner 8.

The distance of the arc N1, N2 is approximately a quarter of the circumference of the photosensitive drum 1, representing an angular displacement of approximately 90°. The arc N1, N2 also may be expressed by $\frac{1}{4}\pi R$, where R is a diameter of the photosensitive drum 1.

On the other hand, the diameter of the transfer roller 61 is $\frac{2}{3}$ times as long as that of the photosensitive drum 1 in this case. Therefore, the circumference of the transfer roller 61 is $\frac{2}{3}\pi R$. Also, one complete revolution of the transfer roller 61 through 360° corresponds to rotation of the photosensitive drum through 240°.

In this case, if the arc N1, N2 ($\frac{1}{4}\pi R$) equals X times as long as the circumference of the transfer roller 61 ($\frac{2}{3}\pi R$), the value X is expressed by a following expression.

$$\frac{1}{4}\pi R = X \times \frac{2}{3}\pi R$$

$$X = \frac{3}{8}$$

That is, the arc N1, N2 equals $\frac{3}{8}$ times as long as the circumference of the transfer roller 61.

As represented in FIG. 4, when the jammed paper is removed and the cover of the apparatus is closed, the control circuit 71 sets the timer 72 to count a new time period (step 120). After that, the control circuit 71 starts rotating the photosensitive drum 1 and the transfer roller 61 (step **122*a*). Simultaneously, the control circuit 71 starts the voltage supply to the charger 21 and the developing roller 44 (step 122*b*). However, the control circuit maintains non-rotation of the developing roller 44 so that toner in the developing device 4 is not supplied to the photosensitive drum 1. The conditions of the developing roller 44, the drum 1 and transfer roller, as well as the respective voltage supplies to be described, are shown at the time T1 in FIG. 5**.

Simultaneously, the control circuit 71 causes the switch 63 to be connected to the negative power source 65 during a time period TA set by the control circuit 71 to be the time required for one revolution of the transfer roller 61 (steps **122*c*, 124 in FIG. 4). As a result, the control circuit 71 causes the circumference of the transfer roller 61, being longer than the arc N1, N2 as described above, to contact the photosensitive drum 1 in a first state during which the circumference of the transfer roller 61 is supplied with negative voltage. Therefore, the toner having negative charge remaining on the arc N1, N2 is repelled against the transfer roller 61 since the potential of the transfer roller 61 (−1350 V) is more negative than that of the arc N1, N2 of the photosensitive drum 1 (−600 V) due to the active state of the charger 21. Further, the toner on the surface of the transfer roller 61 having negative charge is transferred to the surface of the photosensitive drum 1 between the portion N2 and the cleaning blade 82 and the transferred toner is removed by the cleaning blade 82. Although the toner having positive charge remaining on the arc N1, N2 is attracted to the transfer roller 61, the attracted toner having positive charge is transferred to the photosensitive drum 1** in a following manner.

Figure 5:
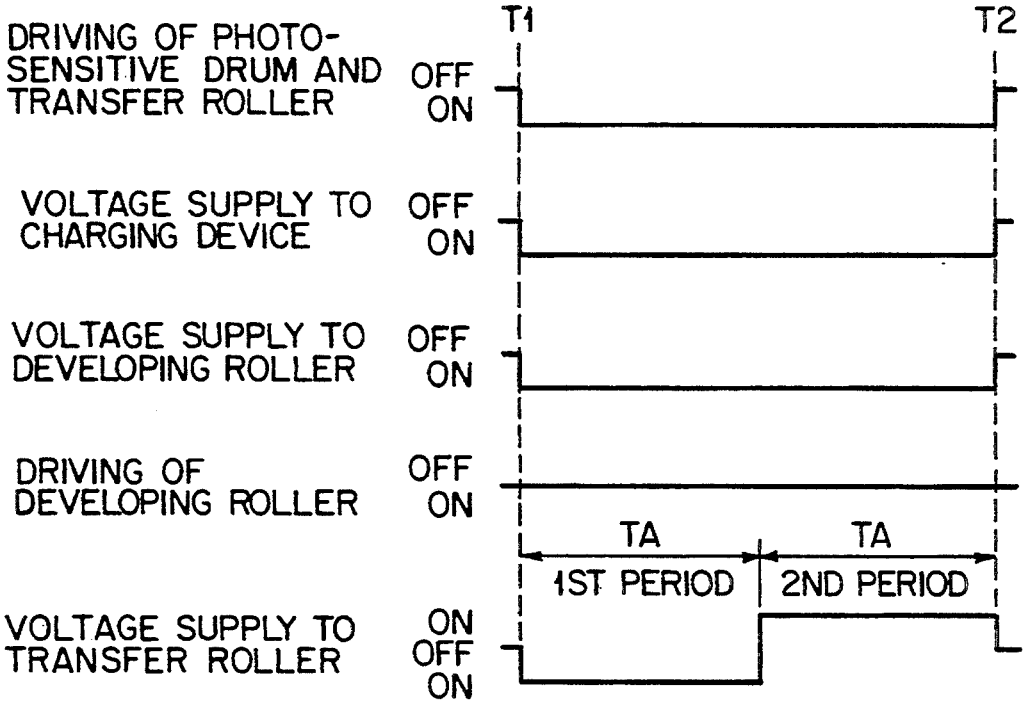
FIG. 5 is a timing chart illustrating a sequence of the first embodiment.

In step 124, if the period TA expires, the control circuit 71 actuates the switch 63 so that the transfer roller 61 is supplied with positive voltage of the power source 64 (step 126). As long as the period 2TA does not expire (step 128), the positive voltage is supplied to the transfer roller 61. As a result, the control circuit 71 causes the circumference of the transfer roller 61 to contact the photosensitive drum 1 in a second state that the circumference of the transfer roller 61 is supplied with positive voltage (1350 V). Therefore, since the potential at the transfer roller (1350 V) is more positive than that at the photosensitive drum 1 (−600 V), the attracted toner having positive charge, attracted on the circumference of the transfer roller 61 during the first period TA, is transferred to the photosensitive drum 1 during a second period ending at the start of a processing operation T2 as shown in FIG. 5.

If the period 2TA expires from the starting time, the control circuit stops driving photosensitive drum 1 and the transfer roller 61 (step 130*a*). Simultaneously, the control circuit stops supplying voltage to the charger 21 and the developing roller 44 (step 130*b*) and stops supplying voltage to the transfer roller 61 (step 130*c*). After that, the control circuit 71 is set to be in a standby state.

According to the first embodiment, the control circuit 71 causes the circumference of the transfer roller 61 to contact the photosensitive drum 1 in the first state in which the circumference of the transfer roller 61 is supplied with negative voltage being more negative than the potential of the photosensitive drum 1 and in the second state in which the circumference of the transfer roller 61 is supplied with the positive voltage being more positive than the potential of the photosensitive drum 1.

Therefore, at the end of the sequence of the first embodiment, the toner having negative charge and positive charge on the arc N1, N2 of the photosensitive drum 1, is not attracted to the transfer roller 61. Further, the toner having negative charge remaining on the transfer roller 61 when the jammed paper is removed is attracted to the photosensitive drum 1. As a result, it prevents the surface of the paper opposite to the recorded surface used in a next recording operation from being dirty due to toner remaining on the transfer roller 61 as occurred in the conventional apparatus.

Although in the first embodiment described, during the second time period, the positive voltage is supplied to the transfer roller 61, a negative voltage, for example, −300 V, more positive than the potential of the photosensitive drum 1 (e.g., −600 V), may be supplied to the transfer roller 61.

Figure 7:
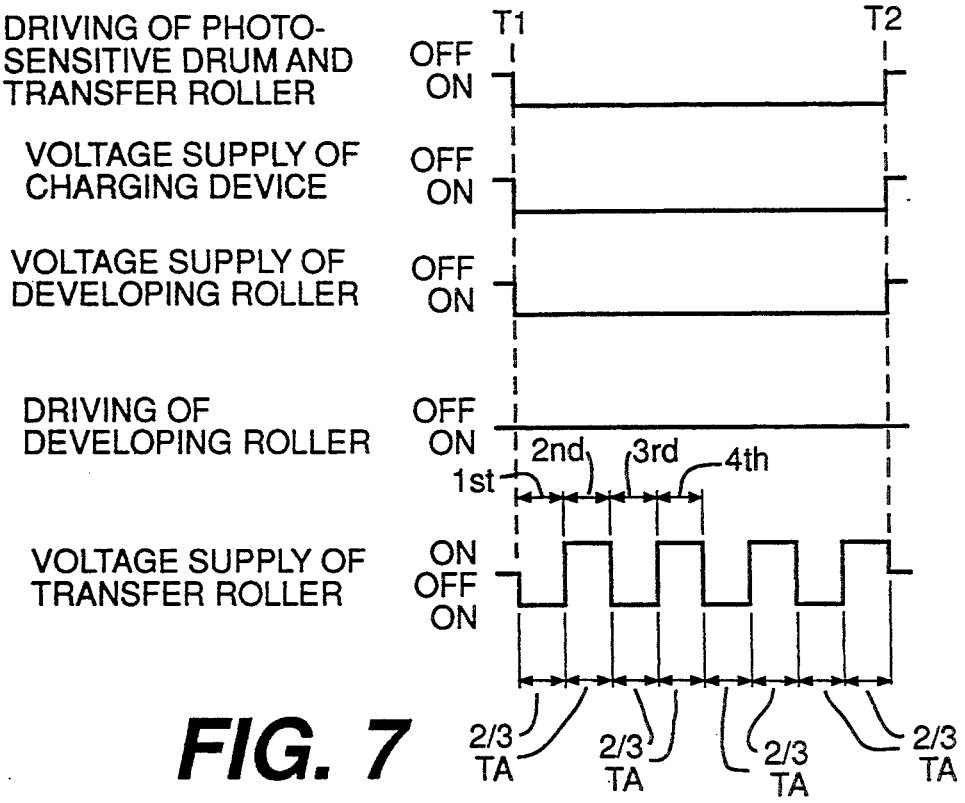
FIG. 7 is a timing chart illustrating a sequence of the second embodiment.
Figure 11:
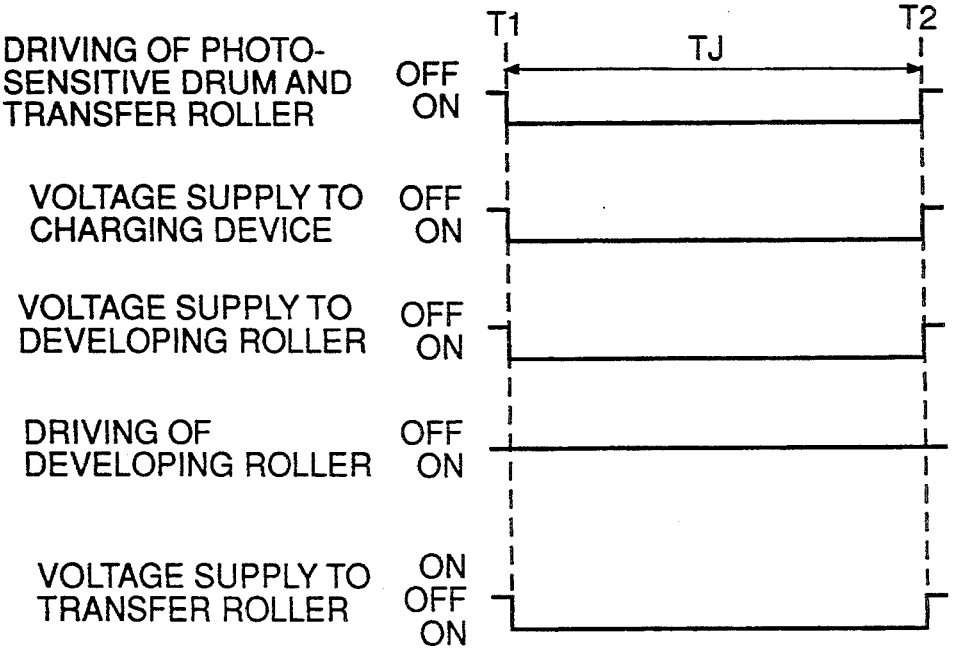
FIG. 11 (PRIOR ART)
FIGS. 10 and 11, as described above, are respectively, a schematic view and a timing chart representing conventional apparatus.

FIG. 7 shows a time chart illustrating a second embodiment of the present invention. The second embodiment is different from the first embodiment with respect to a predetermined period for which the negative and positive voltage is alternatively supplied to the transfer roller 61. The transfer roller 61 is alternatively supplied with negative and positive voltage for the predetermined period which is $\frac{2}{3}$ times as long as the period TA during which the transfer roller 61 rotates once.

Figure 8:
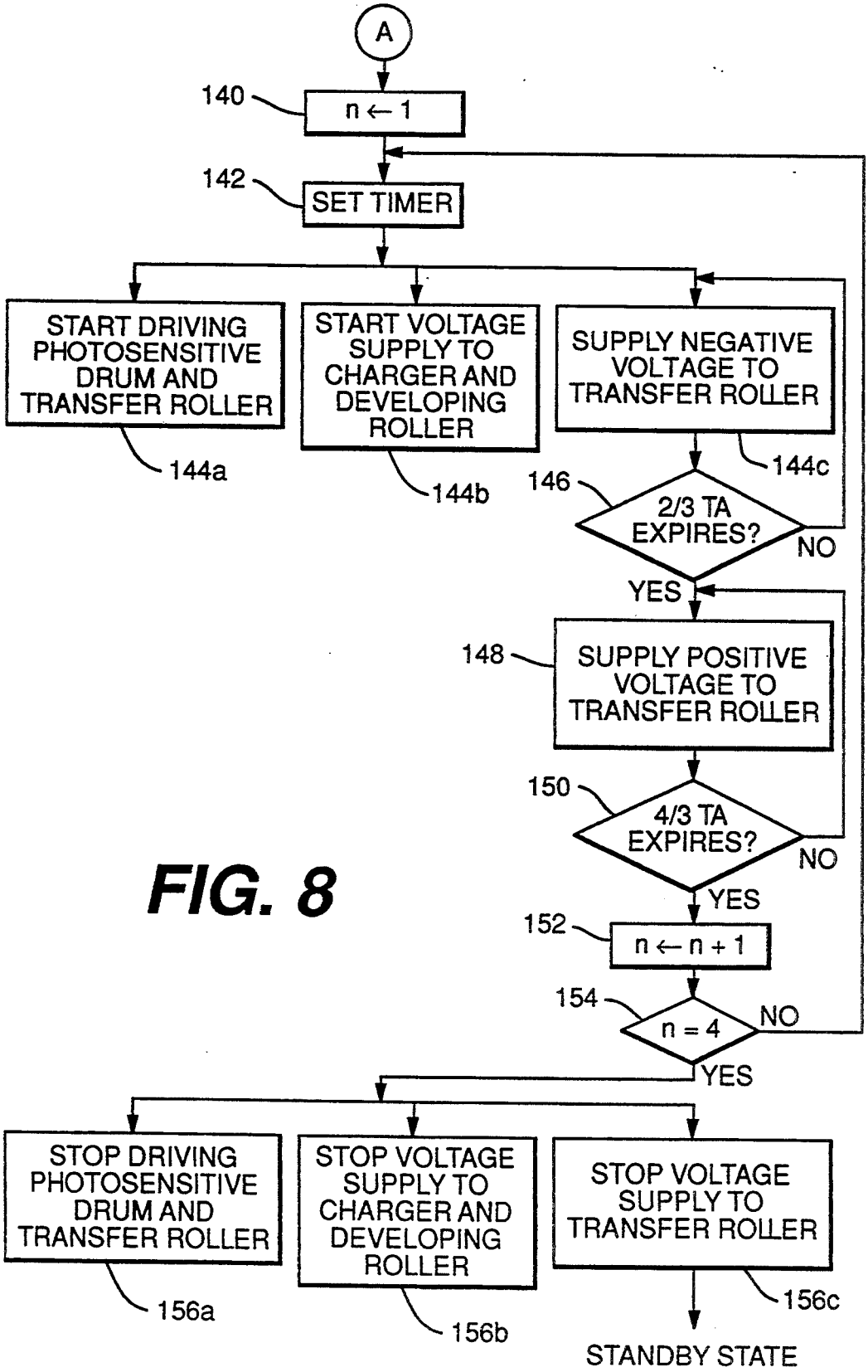
FIG. 8 is a flow chart representing control during operation of the second embodiment.

FIG. 8 shows a transferring cleaning sequence of the second embodiment. After the jammed paper is removed, and the cover is closed in step 118 of FIG. 3, the control circuit 71 sets a value N to "1" (step 140) and the timer 72 (step 142). Thereafter, the control circuit 71 starts driving the photosensitive drum 1 and the transfer roller 61 (step 144*a*) and starts the voltage supply to the charger 21 and the developing roller 44 (step 144*b*). Simultaneously, the control circuit 71 supplies the negative voltage to the transfer roller 61 (step 144*c*). If the period $\frac{2}{3}$ TA expires (step 146), the control circuit 71 actuates the switch 63 to be connected to the positive transfer power source 64 to supply the positive voltage to the transfer roller (step 148). In step 146, if the $\frac{2}{3}$ TA does not expire, the negative voltage continues being supplied to the transfer roller 61. After the step 148, if the period 4/3 TA expires (step 150), the control circuit 71 adds "1" to the value N (step 152). Otherwise, the transfer roller 61 is supplied with the positive voltage. After the step 152, if the value "N" does not match "4" (step 154), the above steps from the step 144c to the step 152 are repeated. If the value "N" matches "4", the control circuit 71 stops driving the photosensitive drum 1 and the transfer roller 61 (step 156*a*), and stops the voltage supply to the charger 21 and the developing roller (step 156*b*) and the transfer roller (step 156*c*). After that, the control circuit 71 is set to be in the standby state.

Figure 9:
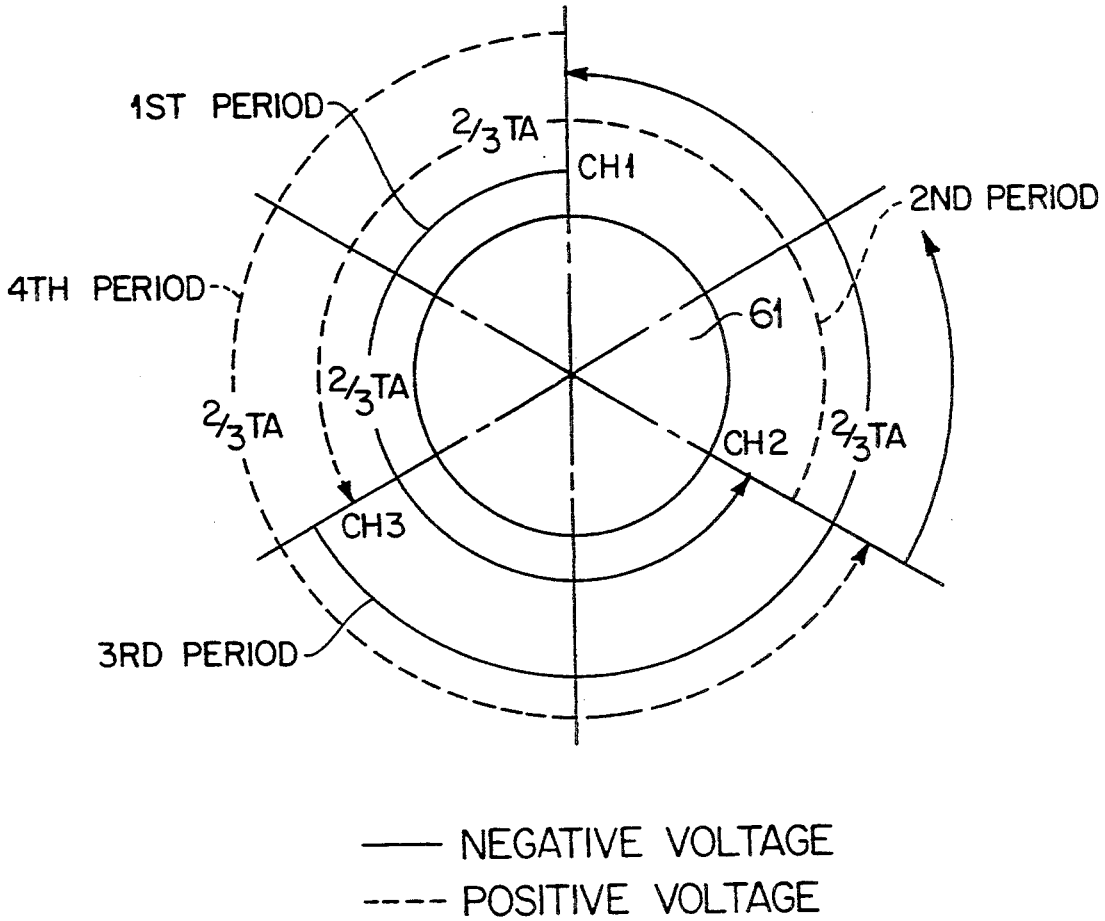
FIG. 9 is a schematic view illustrating a state of the transfer roller when the sequence of the second embodiment is performed.

FIG. 9 shows a state in which the negative and positive voltage is respectively supplied to the transfer roller 61 according to the second embodiment, where the real line shows the area to which the negative voltage is supplied and the dot line shows the area to which the positive voltage is supplied.

The photosensitive drum 1 and the transfer roller 61 rotates for a first period corresponding to $\frac{2}{3}$ TA period. As a result, an area from a portion CH1 of the transfer roller 61 to a portion CH2 of the transfer roller 61 in a counterclockwise direction corresponding to $\frac{2}{3}$ times as long as the circumference of the transfer roller 61, contacts the photosensitive drum 1 in a state in which the area is supplied with negative voltage. Subsequently, for a second period corresponding to $\frac{2}{3}$ TA, an area, from the portion CH2 to a portion CH3 of the transfer roller 61 corresponding to $\frac{2}{3}$ times as long as the circumference of the transfer roller 61, contacts the photosensitive drum 1 in a state in which the area is supplied with positive voltage. After 8/3 TA passes from the time T1, that is, after a fourth period, the circumference of the transfer roller 61 contacts the photosensitive drum 1 in a state in which the circumference of the transfer roller 61 is supplied with negative voltage and positive voltage.

For the first period, referring again to FIGS. 6 and 9, all toner having negative charge remaining on the arc N1, N2 of the photosensitive drum 1 passes the transfer roller 61 since the potential at the photosensitive drum (−600 V) is less negative than the potential at the transfer roller 61 (−1350 V) the distance of the arc N1, N2 corresponding to $\frac{3}{8}$ times as long as the circumference of the transfer roller 61 is shorter than the distance corresponding to $\frac{2}{3}$ times as long as the circumference of the transfer roller 61. Similarly, the toner having negative charge on the area from the portion CH1 to the portion CH2 of the transfer roller 61 is transferred to the photosensitive drum 1.

Although the toner having the positive charge remaining on the arc N1, N2 is attracted to the area from the portion CH1 to the portion CH2 of the transfer roller 61 for the first period, the attracted toner having positive charge, referring again to FIG. 8, is transferred to the photosensitive drum 1 during the second and fourth periods since the area from the portion CH1 to the portion CH2 is supplied with positive voltage for the remaining periods.

Furthermore, the toner having negative charge remaining on the transfer roller 61 when the jammed paper is removed, is attracted to the photosensitive drum 1 during the whole periods since the circumference of the transfer roller 61 contacts the photosensitive drum 1 in a state in which the circumference of the transfer roller 61 is supplied with the negative voltage (−1350 V) more negative than the potential of the photosensitive drum 1 (−600 V).

According to the second embodiment, the toner may be removed from the transfer roller 61 at the end of the fourth period. However, to be sure that all toner is completely removed from the transfer roller 61, the alternating negative and positive voltage supply is continued to the start of a processing operation (T2) as shown in FIG. 7.

Although in the first and second embodiments, the negative voltage and the positive voltage in turn is alternatively supplied to the transfer roller 61 during the period from the time T1 to T2, the positive voltage and the negative voltage in turn may be alternatively supplied to the transfer roller 61.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus comprising:

a rotatable photosensitive member;

charging means for charging the photosensitive member at a predetermined potential;

developing means for supplying toner to the photosensitive member to provide a developed image;

transfer means including a transfer roller for transferring the developed image to a paper sheet;

paper removal detecting means for detecting that a jammed paper is removed from the image forming apparatus;

stopping means responsive to the jammed paper removal detecting means for stopping supply of the toner to the photosensitive member;

rotating means responsive to the paper removal detecting means for rotating the photosensitive member and the transfer roller; and setting means responsive to the paper removal detecting means for setting the circumference of the transfer roller alternately in a first state, in which the circumference of the transfer roller is supplied with a first voltage more negative than the predetermined potential of the photosensitive member, and in a second state in which the circumference of the transfer roller is supplied with a second voltage more positive than the predetermined potential of the photosensitive member.

2. The image forming apparatus of claim 1, further comprising paper jam detecting means for detecting the presence of a jammed paper in the image forming apparatus, and prompting means responsive to the paper jam detecting means for informing a user of the need to remove the jammed paper.

3. The image forming apparatus of claim 2, wherein the prompting means includes display means for displaying visual information of the presence of a paper jam in the apparatus and of the need to remove the jammed paper.

4. The image forming apparatus of claim 1, wherein the developing means comprises a developing roller rotating in contact with the photosensitive member.

5. The image forming apparatus of claim 4, wherein the photosensitive member includes a developing contact portion in contact with the developing roller, and the setting means comprises supply means for supplying, in response to the paper removal detecting means, only one of the first and second voltage to the transfer roller for more than a period of time during which the developing contact portion moves from the developing roller to the transfer roller as a result of rotation of the photosensitive member.

6. The image forming apparatus of claim 4, wherein the stopping means stops supply of the toner from the developing roller to the photosensitive member by terminating rotation of the developing roller.

7. The image forming apparatus of claim 1, wherein the setting means comprises voltage supply means for alternately supplying the first and second voltage to the transfer roller for a time period shorter than the time required for one revolution of the transfer roller.

8. The image forming apparatus of claim 7, wherein the voltage supply means comprises switching means for switching alternately the first and second voltage to the transfer roller so that the transfer roller has more than one voltage switching point, wherein when one of the voltage switching points contacts the photosensitive member, one of the first and second supplied voltage to the transfer roller is switched to the other.

9. The image forming apparatus of claim 1, wherein the first voltage is a negative voltage and the second voltage is a positive voltage.

10. A method of removing toner from a transfer roller included in an image forming apparatus, after a paper jam occurs therein, the image forming apparatus also including a rotatable photosensitive member, the method comprising the steps of:

charging the photosensitive member at a predetermined potential;

developing a latent image to form a developed image by supply of toner to the photosensitive member;

transferring the developed image to a paper sheet by the transfer roller;

detecting removal of a jammed paper from the image forming apparatus;

stopping supply of the toner to the photosensitive member in response to detection of the jammed paper removal;

rotating the photosensitive member and the transfer roller; and setting the circumference of the transfer roller alternately in a first state, in which the circumference of the transfer roller is supplied with a first voltage more negative than the predetermined potential of the photosensitive member, and in a second state in which the circumference of the transfer roller is supplied with a second voltage more positive than the predetermined potential of the photosensitive member.

11. The method of claim 10, wherein the image forming apparatus further comprises a developing roller, and the step of stopping the supply of toner is performed by terminating rotation of the developing roller.

* * * * *